US005647535A

United States Patent [19]

Nakazono et al.

[11] Patent Number: 5,647,535

[45] Date of Patent: Jul. 15, 1997

[54] METHOD OF METALLIC PAINTING

[75] Inventors: Daisuke Nakazono; Shuji Monoura; Kazuo Nakagawa, all of Saitama-ken, Japan

[73] Assignee: Honda Giken Kogyo Kabushiki Kaisha, Saitama, Japan

[21] Appl. No.: 546,884

[22] Filed: Oct. 20, 1995

[30] Foreign Application Priority Data

Oct. 21, 1994 [JP] Japan ..... 6-257186

[51] Int. Cl.[6] ..... B05B 7/04; B05D 1/02

[52] U.S. Cl. ..... 239/7; 239/8; 427/480

[58] Field of Search ..... 239/7, 8, 223–225, 239/690, DIG. 14, 289, 340, 355, 363, 366; 427/426, 475, 479, 480; 118/323, 326

[56] References Cited

U.S. PATENT DOCUMENTS

| | | | |
|---|---|---|---|
| 2,607,983 | 8/1952 | McBride | 427/476 X |
| 2,996,042 | 8/1961 | Juvinall | 427/480 X |
| 3,178,118 | 4/1965 | New | 427/426 X |
| 3,281,076 | 10/1966 | Burnside et al. | 239/7 |
| 4,368,223 | 1/1983 | Kobayashi et al. | 427/426 X |
| 4,702,932 | 10/1987 | Cosenfino et al. | 427/486 X |
| 5,073,409 | 12/1991 | Anderson et al. | 422/426 X |
| 5,186,388 | 2/1993 | Chapman et al. | 239/8 |

FOREIGN PATENT DOCUMENTS 2229941 10/1990 United Kingdom .

OTHER PUBLICATIONS

Derwent WPI abstract 89–232666/32 & JP 890034102 (1996).

*Primary Examiner*—Kevin Weldon

*Attorney, Agent, or Firm*—Weiner, Carrier & Burt, P.C.; Joseph P. Carrier; Irving M. Weiner

[57] ABSTRACT

The present invention relates to an efficient method of applying a metallic paint using both an air atomized spray machine and a spin coating machine. In the method of painting, matching the color shade of metallic painting using an air atomized spray machine with the color shade of metallic painting using a spin coating machine is achieved in the following manner. The overall content of the metallic pigment in the metallic paint for said air atomized spray machine and for said spin coating machine is maintained almost the same, but the ratio of the brilliant pigment and the color pigment composing said metallic pigment is varied to increase the content of the brilliant pigment in the metallic paint for the spin coating machine compared with the content in the metallic paint for the air atomized spray machine. The disclosed method enables metallic painting using both an air atomized spray machine and a spin coating machine in combination under the condition of less color difference than has conventionally been possible.

14 Claims, 1 Drawing Sheet

METHOD OF METALLIC PAINTING

BACKGROUND OF THE INVENTION

1. Field of the Invention

The present invention relates to an improved method of metallic painting for motor vehicles and the like, in which an air atomized spray machine and a spin coating machine are used in combination.

2. Description of the Related Art

In metallic painting, such as top coating on car bodies, an air atomized spray machine has conventionally been used, because good alignment of metallic pigments, such as aluminum flakes, is achieved. In some applications, however, a bell-type spin coating machine is used in combination with a air atomized spray machine because of its high efficiency. The expression "metallic painting" used herein means painting using a paint containing brilliant pigments such as aluminum flakes or mica flakes.

It has been known that the finished appearance of a metallic paint, such as color shade and brightness, differs significantly between painting using an air atomized spray machine and painting using a bell-type spin coating machine.

A painting method by the combined use of an air atomized spray machine and a bell-type spin coating machine is disclosed, for example, in Japanese Patent Publication No. HEI 1-34102, which describes a painting method for eliminating differences or non-unformities in the finished appearance of metallic painting.

The disclosed technique, when a bell-type spin coating machine is used for metallic painting, is a method for finishing metallic painting, in which a surface that is to paint using a bell-type coating machine is painted using an air or airless spray machine before or after painting using the bell-type machine. The content of metallic pigments in the metallic paint applied using the air or airless coating machine is 30 to 90 percent by weight of metallic pigments contained in the metallic paint applied using the bell-type machine.

In this method, when an air atomized spray machine is used for painting, the content of metallic pigments in the metallic paint, compared to painting using a bell-type spin coating machine, is decreased to 30 to 90 percent by weight of metallic pigments contained in the metallic paint applied using the bell-type machine in order to eliminate color differences.

Although the known method for eliminating color differences by adjusting the content of metallic pigments is effective to some extent on the finished appearance, differ in hue or brightness occur, because this method produces a state as if the color were thinned before painting.

It is therefore an object of the present invention to provide a method for applying a metallic paint, in which painting using an air atomized spray machine and painting using a bell-type spin coating machine are combined to minimize color differences while maintaining the high painting efficiency of the bell-type spin coating machine.

SUMMARY OF THE INVENTION

According to an aspect of the present invention, there is provided a method of applying a metallic paint for matching color shade when metallic painting is performed using an air atomized spray machine with color shade when metallic painting is performed using a spin coating machine, wherein the overall content of metallic pigments in the metallic paint used by the air atomized spray machine is maintained almost the same as the overall content of metallic pigments in the metallic paint used by the spin coating machine, but the ratio of the brilliant and color pigments composing the metallic pigment is changed to increase the content of the brilliant pigment in the metallic paint for the spin coating machine compared with the metallic paint for the air atomized spray machine.

In the painting method for matching the color shade that resulted from metallic painting by use of an air atomized spray machine with the color shade that resulted from metallic painting by use of a spin coating machine, when painting is performed by use of the air atomized spray machine, although color differences may be reduced, compared to when metallic painting is performed by use of a spin coating machine, by decreasing the content of the metallic pigment in the metallic paint for the air atomized spray machine to 30 to 90 percent by weight of the content of the metallic pigment in the metallic paint for the spin coating machine, differences in hue and brightness occur because of the decreased metallic pigment content.

According to the present invention, since painting using an air atomized spray machine is combined with painting using a spin coating machine while maintaining the overall content of metallic pigments in the metallic paint for both machines almost the same, but varying the ratio of the brilliant and color pigments composing the metallic pigment to increase the content of the brilliant pigment in the metallic paint for the spin coating machine compared with the metallic paint for the air atomized spray machine, both the air atomized spray and spin coating machines may be used in combination with significantly reduce occurrence of differences in hue and brightness.

BRIEF DESCRIPTION OF THE DRAWINGS

Embodiments of the present invention will now be described, by way of example only, with reference to the accompanying drawings, in which.

DETAILED DESCRIPTION

The present invention relates to a painting method for matching color shade from metallic painting by use of an air atomized spray machine with color shade from metallic painting by use of a spin coating machine.

According to the present invention, when metallic painting is performed using the air atomized spray machine and the spin coating machine described above, the ratio of metallic pigments contained in metallic paints for the air atomized spray machine and the spin coating machine is maintained almost the same, but the ratio of brilliant and color pigments composing the metallic pigment is changed for application by the different machines.

The ratio of the brilliant pigment in the metallic pigment contained in the metallic paint for the spin coating machine is increased compared with that for the air atomized spray machine.

The air atomized spray machine sucks and atomizes the paint supplied from the paint nozzle using compressed air blown from, for example, an air cap (providing an electric charge to atomized paint in the static system) for spray painting. In metallic painting, since the blowing pressure is relatively high, this machine is frequently used because of the good alignment of brilliant pigments such as aluminum flakes that results there from.

On the other hand, in the bell-type spin coating machine, a bell-shaped rotary disc is rotated at a high speed to spray the paint supplied on the center of the disc by centrifugal force along the internal surface of the rotary disc in the peripheral direction, and shaving air is blown from the periphery to adjust the painting pattern for highly efficient painting.

Therefore, when a metallic paint is applied using a spin coating machine such as the bell type, painting efficiency is increased. However, since the blowing pressure of the paint is relatively low, the alignment of the brilliant pigment such as aluminum flakes is made random, and the hue is darkened.

In general, in order to improve the alignment of the brilliant pigment in the metallic paint, the control of the thickness of paint film and change in viscosity during drying is said to be important, and in order to eliminate or minimize color difference, it is important to maintain change in viscosity during drying constant.

It is therefore considered that if color difference is eliminated or reduced by increasing the ratio of the brilliant pigment in the paint for the spin coating machine and maintaining the total amount of the metallic pigment (ratio of the metallic pigment contained in the metallic paint) almost the same, differences in the solvent component of the paint polymer or in the volatile component of the solvent are unlikely to occur, and change in viscosity during drying is easily maintained, effectively improving or reducing color differences.

EMBODIMENTS

The preferred embodiments of the present invention will now be described referring to the following table and drawing figures.

Figure 1:
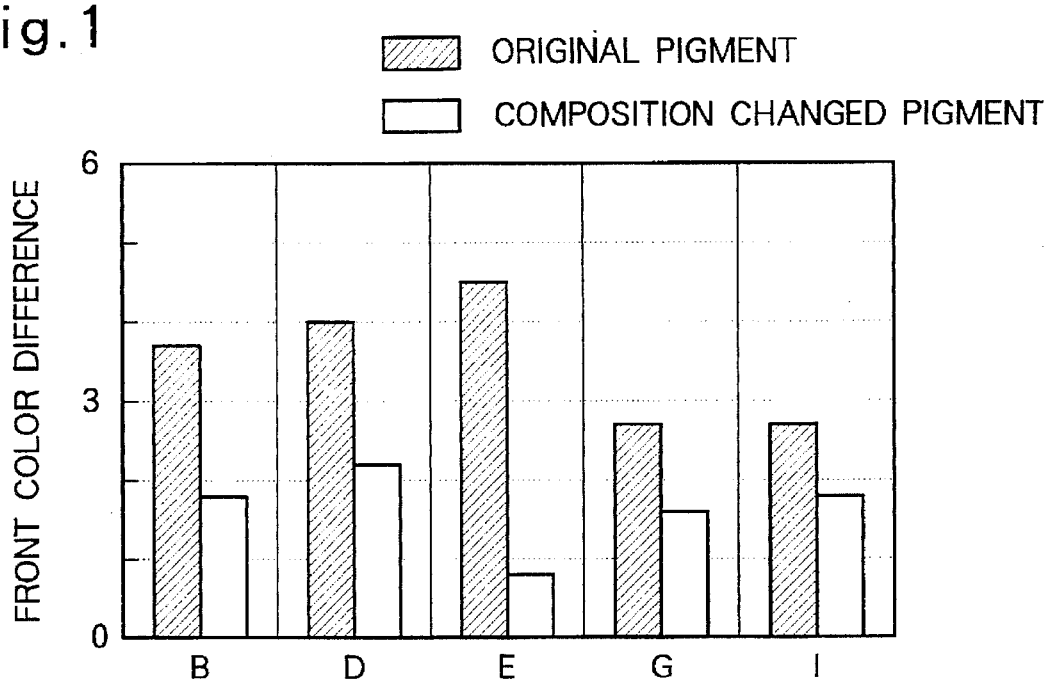
FIG. 1 is a graph of the front color difference comparing the results of color difference improvement by the composition modified pigment according to the present invention with the original pigment.
Figure 2:
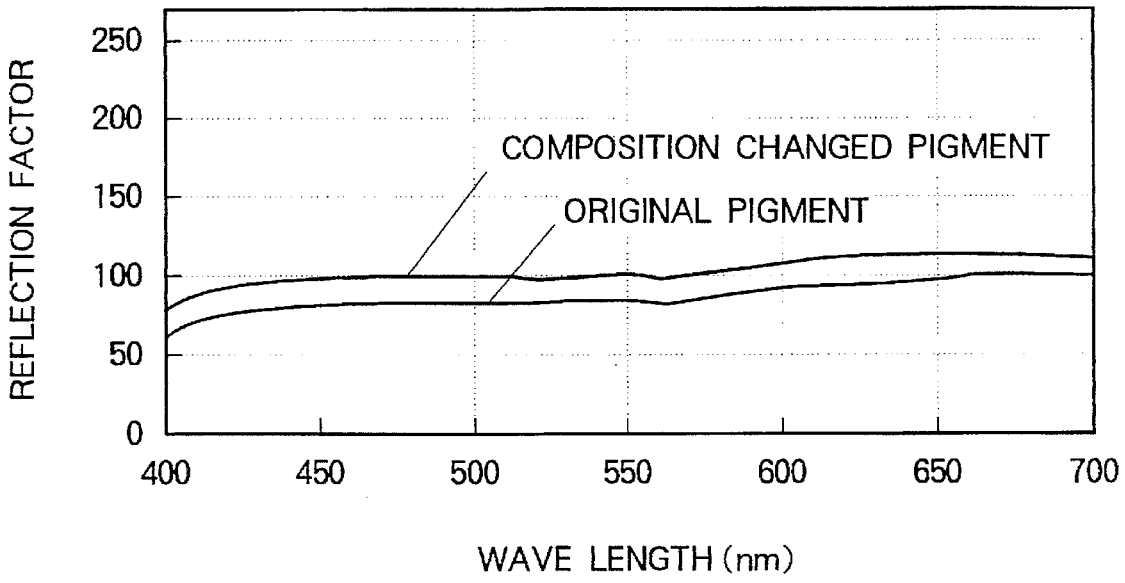
FIG. 2 is a graph of the spectral reflection factors of the composition modified pigment according to the present invention and the original pigment.

The table shows the test results for various colors when the content of the brilliant pigment is changed, and the painting conditions. FIG. 1 shows an example of the results of improvement in color difference, and FIG. 2 is a graph of spectral reflection factors showing the effect of changing the composition of the pigment.

| | | Pigment (air spray etc.) | | Pigment (bell-type) | | |
|---|---|---|---|---|---|---|
| Color symbol | Color | Brilliant pigment | Color pigment | Brilliant pigment | Color pigment | Film thickness |
| A | Red pearl 1 | Color P 3.4% | 4.0% | Color P 4.2% | 3.2% | 20μ |
| B | Red pearl 2 | Color P 1.5%<br>Interference P 0.5% | 4.6% | Color P 1.96%<br>Interference P 0.96% | 3.68% | 20μ |
| C | Silver metallic | Aluminum 5.5% | 0.5% | Aluminum 5.6% | 0.4% | 11μ |
| D | Beige metallic | Aluminum 2.8% | 0.7% | Aluminum 2.94% | 0.56% | 10μ |
| E | Green metallic 1 | Aluminum 2.8% | 0.9% | Aluminium 2.98% | 0.72% | 12μ |
| F | Green metallic 2 | Interference P 1.8% | 2.1% | Interference P 2.22% | 1.68% | 10μ |
| G | Blue pearl 1 | Interference P 2.9%<br>Graphite 0.6% | 0.8% | Interference P 2.98%<br>Graphite 0.68% | 0.64% | 10μ |
| H | Blue pearl 2 | White P 1.4%<br>Interference P 0.9% | 2.3% | White P 1.68%<br>Interference P 1.08% | 1.84% | 10μ |
| I | Gray pearl 1 | Color P 3.8% | 1.0% | Color P 4.0% | 0.8% | 15μ |
| J | Gray metallic | Aluminum 1.4% | 1.1% | Aluminum 1.62% | 0.88% | 10μ |

| Color symbol | Stage | Discharge amount | Rotation speed | Reciprocating Stroke | Reciprocating Speed | Interval (1st–2nd) |
|---|---|---|---|---|---|---|
| A | 1-pass | 100 | 20000 | Same conditions | Same conditions | 80 |
| | 2-pass | 100 | 10000 | | | |
| B | 1-pass | 100 | 20000 | | | ↑ |
| | 2-pass | 100 | 10000 | | | |
| C | 1-pass | 60 | 20000 | | | ↑ |
| | 2-pass | 60 | 10000 | | | |
| D | 1-pass | 70 | 20000 | | | ↑ |
| | 2-pass | 70 | 10000 | | | |
| E | 1-pass | 70 | 20000 | | | ↑ |
| | 2-pass | 70 | 10000 | | | |
| F | 1-pass | 70 | 20000 | | | ↑ |
| | 2-pass | 70 | 10000 | | | |

-continued

| | | | | |
|---|---|---|---|---|
| G | 1-pass | 70 | 20000 | ↑ |
| | 2-pass | 70 | 10000 | |
| H | 1-pass | 70 | 20000 | ↑ |
| | 2-pass | 70 | 10000 | |
| I | 1-pass | 100 | 20000 | ↑ |
| | 2-pass | 100 | 10000 | |
| J | 1-pass | 70 | 20000 | ↑ |
| | 2-pass | 70 | 10000 | |

A metallic paint used for the top coating of motor vehicles and the like contains as its components a metallic pigment consisting of a brilliant pigment such as aluminum flakes or mica flakes and color pigments, a polymer component such as polyacrylate or melamine-formaldehyde resin, a solvent facilitating the paint to be applied, and additives consisting of surface preparation agents such as an ultraviolet absorbent or an antisettling agent. For example, the metallic paint is applied as the base coat, on which a clear coating is applied to provide a high-quality appearance by changing brightness and hue depending on the angle of viewing known as a flip-flop tone.

Although the compositions of such metallic paints differ depending on the types of pigments or solvents, an example of a metallic paint consists of 5.2 percent metallic pigment, 34.1 percent polymer, 54.1 percent solvent, and 6.6 percent additives. The metallic pigment contains 4/5.2 percent brilliant pigment such as aluminum flakes and mica flakes, and about 1.2/5.2 percent inorganic or organic color pigments.

When such a metallic pigment is applied using an air atomized spray machine such as an air spray or electrostatic air spray machine, the random movement of the brilliant pigment such as aluminum flakes is inhibited by a high spraying pressure, and tends to align in parallel to the coating layer. In metallic painting, therefore, air spray machines are frequently used.

On the contrary, when a metallic paint is applied using a bell-type spin coating machine such as a bell-type spray gun, the brilliant pigment is poorly aligned compared with the alignment achieved using an air spray machine, and the amount of the brilliant pigment in the direction intersecting the coating layer increases, resulting in darker hue.

In the present invention, the ratio of brilliant and color pigments contained in the paint to be applied using a bell-type spray gun is changed. That is, the content of the brilliant pigment in the metallic pigment of the paint for the bell-type spray gun is increased compared with the content of the brilliant pigment for the air spray machines and the like. As a matter of course, the amount of color pigments contained in the paint to be applied using a bell-type spray gun is decreased by the same amount that the brilliant pigment is increased.

The embodiments of the present invention are as shown in the table above. For example, the metallic paint of the color symbol A (color: red-pearl 1) is as follows:

The paint for an air spray machine contained 3.4 percent brilliant pigment (Color P) and 4.0 percent color pigment, for a combined 7.4 percent metallic pigment, while the paint for a bell-type spray gun contained 4.2 percent brilliant pigment (Color P) and 3.2 percent color pigment, for a combined 7.4 percent metallic pigment. The paint was applied by reciprocating the spray gun in two runs. The rotation speeds of the spray gun in the first and second runs were 20,000 rpm and 10,000 rpm, respectively, to form a coating film of a total thickness of 20 μm.

The reason why the paint was applied in two runs was that a relatively thin film was formed in the first run to align the brilliant pigment and to increase the painting efficiency. The first and second runs were performed at the rotation speeds of 20,000 rpm and 10,000 rpm, respectively, for the following reasons.

By performing the first run at a relatively high rotation speed of about 20,000 rpm, the volatile components such as solvents were evaporated from the sprayed paint to increase the viscosity rapidly and inhibit the random movement of the brilliant pigment, as well as to stabilize the hardness of the coating early for eliminating any adverse effect on the alignment of the brilliant pigment during the second run. The reason why the second run was performed at a rotation speed of 10,000 rpm was to improve the alignment of the brilliant pigment.

For color symbol B (color: red pearl 2), the paint for an air spray machine contained 2.0 percent brilliant pigment (1.5% Color P and 0.5% Interference P) and 4.6 percent color pigment, therefore 6.6 percent metallic pigment overall, while the paint for a bell-type spray gun contained 2.29 percent brilliant pigment (1.96% Color P and 0.96% Interference P) and 3.68 percent color pigment, therefore 6.6 percent metallic pigment overall.

For color symbol C (color: silver metallic), the paint for an air spray machine contained 5.5 percent brilliant pigment (aluminum) and 0.5 percent color pigment, therefore 6.0 percent metallic pigment overall, while the paint for a bell-type spray gun contained 5.6 percent brilliant pigment (aluminum) and 0.4 percent color pigment, therefore 6.0 percent metallic pigment overall.

For color symbol D (color: beige metallic), the paint for an air spray machine contained 2.8 percent brilliant pigment (aluminum) and 0.7 percent color pigment, therefore 3.5 percent metallic pigment overall, while the paint for a bell-type spray gun contained 2.94 percent brilliant pigment (aluminum) and 0.56 percent color pigment, therefore 3.5 percent metallic pigment overall.

For color symbol E (color: green metallic 1), the paint for an air spray machine contained 2.8 percent brilliant pigment (aluminum) and 0.9 percent color pigment, therefore 3.7 percent metallic pigment overall, while the paint for a bell-type spray gun contained 2.98 percent brilliant pigment (aluminum) and 0.72 percent color pigment, therefore 3.7 percent metallic pigment overall.

For color symbol F (color: green metallic 2), the paint for an air spray machine contained 1.8 percent brilliant pigment (Interference P) and 2.1 percent color pigment, therefore 3.9 percent metallic pigment overall, while the paint for a bell-type spray gun contained 2.22 percent brilliant pigment (Interference P) and 1.68 percent color pigment, therefore 3.9 percent metallic pigment overall.

For color symbol G (color: blue pearl 1), the paint for an air spray machine contained 3.5 percent brilliant pigment (2.9% Interference P and 0.6% graphite) and 0.8 percent color pigment, therefore 4.3 percent metallic pigment overall, while the paint for a bell-type spray gun contained 3.66 percent brilliant pigment (2.98% Interference P and 0.68% graphite) and 0.64 percent color pigment, therefore 4.3 percent metallic pigment overall.

For color symbol H (color: blue pearl 2), the paint for an air spray machine contained 2.3 percent brilliant pigment (1.4% White P and 0.9% Interference P) and 2.3 percent color pigment, therefore 4.6 percent metallic pigment overall, while the paint for a bell-type spray gun contained 2.78 percent brilliant pigment (1.63% White P and 1.15% Interference P) and 1.84 percent color pigment, therefore 4.62 percent metallic pigment overall.

For color symbol I (color: gray pearl), the paint for an air spray machine contained 3.8 percent brilliant pigment (Color P) and 1.0 percent color pigment, therefore 4.8 percent metallic pigment overall, while the paint for a bell-type spray gun contained 4.0 percent brilliant pigment (Color P) and 0.8 percent color pigment, therefore 4.8 percent metallic pigment overall.

For color symbol J (color: gray metallic), the paint for an air spray machine contained 1.4 percent brilliant pigment (aluminum) and 1.1 percent color pigment, therefore 2.5 percent metallic pigment overall, while the paint for a bell-type spray gun contained 1.62 percent brilliant pigment (aluminum) and 0.88 percent color pigment, therefore 2.5 percent metallic pigment overall.

An example of the improvement of color difference, by equalizing the content of the metallic paint in the metallic paint for the air spray machine and the bell-type spray gun, and increasing the content of the brilliant pigment in each metallic pigment for the bell-type spray gun compared to the pigment for the air spray machine, is shown in FIG. 1 as the comparison of front color difference. In the graph of FIG. 1, the abscissa shows examples based on color symbols, and the ordinate shows front color difference.

In the graph of FIG. 1, color difference when the original paint was applied using a bell-type spray gun is shown by hatched areas, and color difference when the composition of the paint was changed according to the invention is shown by white areas.

It is known from FIG. 1 that color difference when the composition of the paint was changed as shown by white areas is significantly less than the color difference of the original pigment as shown by hatched areas for all the colors.

Here, color difference (ΔE) is the value obtained by measuring the tristimulus values for a specific wavelength using a colorimeter, which are converted to colorimetric system of the equal color difference space under standard illuminant, Vx, Vy and Vz, and using the Adams formula shown below. In general, when color difference is 3.0 to 6.0, significant difference in color is visually detected; when color difference is 1.5 to 3.0, difference in color is visually detected; when color difference is 0.5 to 1.5, a slight difference in color is visually detected.

As FIG. 1 shows, the color difference of Examples B, D, E, G and I using pigments whose composition was changed as shown by white areas was about 2.0 or less, whereas the color difference for the original pigment for these Examples as shown by hatched areas was in a range of about 4.6–2.7. Therefore, it is understood that the color difference has been decreased.

The formula for obtaining color difference is as follows:

$$\Delta E=40\{\Delta(Vx-Vy)^2+(0.23\Delta Vy)^2+[0.4\Delta(Vz-Vy)^2]\}^{0.5}$$

where Δ(Vx−Vy) is difference in hue, Δ(Vz−Vy) is difference in chroma, and ivy is difference in lightness.

FIG. 2 is a graph of spectral reflection factors showing the effect of changing the composition of the pigment in color symbol D described above. The abscissa shows wavelength (nm) and the ordinate shows reflection factor.

It is known that the reflection factor of the pigment of color symbol D whose composition was changed was higher than the reflection factor of the original paint in all the wavelengths (nm), and that darkness was improved as a whole.

In metallic painting in general, the first key to obtain a flip-flop tone with a high quality appearance is the alignment of the brilliant pigment in the coating film, and for this alignment, the control of change in viscosity during drying the film is important. According to the present invention, since only the ratio of brilliant and color pigments is changed while maintaining the content of the metallic pigment in the metallic paint almost the same, the release of solvents from the paint polymer, and the volatility of the solvents are easily maintained, and change in viscosity during curing is considered to be maintained constant.

By improving color difference when a bell-type spray gun is used for metallic painting, the use of the bell-type spray gun having a high painting efficiency is not hindered, and efficient painting becomes possible.

Although a bell-type spray gun is used in the above-described embodiments as a spin coating machine, the present invention is not limited to the bell-type spray gun.

As described above, according to the present invention, since color difference is reduced by increasing the content of the brilliant pigment composing the metallic pigment in the metallic paint for an air atomized spray machine compared with the content in the metallic paint for a spin coating machine, while maintaining the content overall of the metallic pigment in the metallic paint almost the same, both machines may be used in combination for achieving significantly of less color difference than conventional methods. According to the present invention, color difference is improved in metallic painting, and motor vehicles having excellent metallic coatings can be obtained in an efficient manner involving use of a bell-type spin coating spray gun.

The scope of the invention is indicated by the appended claims, rather than by the foregoing, non-limiting examples of preferred embodiments of the invention.

What is claimed is:

1. A method of metallic painting for matching color shade of metallic painting using an air atomized spray machine with color shade of metallic painting using a spin coating machine, wherein, a content of the metallic pigment in the metallic paint for said air atomized spray machine and for said spin coating machine is maintained almost the same, and a ratio of brilliant pigment and color pigment composing said metallic pigment is varied to increase the content of the brilliant pigment in the metallic paint for the spin coating machine compared with the content in the metallic paint for the air atomized spray machine.

2. A method of painting a metallic paint according to claim 1, wherein said spin coating machine is a bell-type spin coating machine.

3. A method of painting a metallic paint according to claim 1, wherein said air atomized spray machine is one of an air spray machine and electrostatic air spray machine.

4. A method of painting a metallic paint according to claim 1, wherein the content of the metallic pigment in the metallic paint for said air atomized spray machine and for said spin coating machine is maintained the same.

5. A method according to claim 1, wherein a change in viscosity in the metallic paint during drying thereof is maintained substantially constant.

6. A method for matching color shade of metallic paint applied by an air atomized spray machine with color shade of the metallic paint applied by a spin coating machine, comprising the steps of:

maintaining an overall content of metallic pigment in the metallic paint substantially constant for the paint applied using the air atomized spray machine and the paint applied using the spin coating machine; and varying a ratio of brilliant pigment and color pigment composing said metallic pigment such that a content of the brilliant pigment in the metallic paint applied by the spin coating machine is increased compared with a content of the brilliant pigment in the metallic paint applied by the air atomized spray machine.

7. A method of matching color shade according to claim 6, wherein said spin coating machine is a bell-type spin coating machine.

8. A method for matching color shade according to claim 6, wherein said air atomized spray machine is one of an air spray machine and an electrostatic air spray machine.

9. A method for matching color shade according to claim 6, wherein the content of metallic pigment in the metallic paint applied by said air atomizing spray machine and by said spin machine is maintained the same.

10. A method of painting using metallic paint, comprising the steps of:

applying the metallic paint using an air atomized spray machine in combination with a spin coating machine; and modifying a composition of the metallic paint as applied using the air atomized spray machine in comparison to that applied using the spin coating machine such that a ratio of brilliant pigment and color pigment composing the overall metallic pigment content of the metallic paint is varied to increase the content of the brilliant pigment in the metallic paint for the spin coating machine compared with the content of the brilliant pigment in the metallic paint for the air atomized spray machine, while maintaining the overall content of the metallic pigment in the metallic paint for the air atomized spray machine substantially the same as the overall content of the metallic pigment in the metallic paint for the spin coating machine.

11. A method of painting according to claim 10, wherein spin coating machine is a bell-type coating machine.

12. A method of painting according to claim 10, wherein said air atomized spray machine is one of an air spray machine and an electrostatic air spray machine.

13. A method of painting according to claim 10, wherein the overall content of the metallic pigment in the metallic paint for said air atomized spray machine and for said spin coating machine is maintained the same.

14. A method of painting according to claim 10, wherein a change in viscosity of the metallic paint during drying is maintained substantially constant.

* * * * *

UNITED STATES PATENT AND TRADEMARK OFFICE

CERTIFICATE OF CORRECTION

PATENT NO. : 5,647,535

DATED : July 15, 1997

INVENTOR(S) : Daisuke Nakazono, Shuji Minoura, Kazuo Nakagawa

It is certified that error appears in the above-indentified patent and that said Letters Patent is hereby corrected as shown below:

Column 1, line 34, after "is" insert --difficult--.

Column 1, line 52, change "differ" to --differences--

Column 3, line 6, change "there from" to --therefrom--.

Column 8, line 34, reverse the words "overall" and "content".

Column 8, line 37, delete "of".

Column 8, line 63, after "and" insert --an--.

Signed and Sealed this

Fourth Day of November, 1997

*Attest:*

Bruce Lehman

BRUCE LEHMAN

*Attesting Officer*

*Commissioner of Patents and Trademarks*